US011646003B1

(12) United States Patent
Dunnett

(10) Patent No.: US 11,646,003 B1
(45) Date of Patent: May 9, 2023

(54) BASS DRUM PEDAL COMPRESSION MECHANISM

(71) Applicant: Ronn Dunnett, Delta (CA)

(72) Inventor: Ronn Dunnett, Delta (CA)

( * ) Notice: Subject to any disclaimer, the term of this patent is extended or adjusted under 35 U.S.C. 154(b) by 0 days.

(21) Appl. No.: 17/491,538

(22) Filed: Oct. 1, 2021

Related U.S. Application Data

(60) Provisional application No. 63/125,241, filed on Dec. 14, 2020, provisional application No. 63/086,553, filed on Oct. 1, 2020.

(51) Int. Cl.
*G10D 13/11* (2020.01)

(52) U.S. Cl.
CPC ..... *G10D 13/11* (2020.02)

(58) Field of Classification Search
CPC ..... G10D 13/11; G10D 13/00
See application file for complete search history.

(56) References Cited

U.S. PATENT DOCUMENTS

| | | | |
|---|---|---|---|
| 60,421 | A | 12/1866 | Quincy |
| 144,198 | A | 11/1873 | Ford |
| 226,442 | A | 4/1880 | Clawson |
| 2,132,211 | A | 10/1938 | Walter |
| 2,581,515 | A | 1/1952 | Otto |
| 3,439,574 | A | 4/1969 | Ramsey |
| 3,677,128 | A | 7/1972 | Simpson |
| 3,722,349 | A | 3/1973 | Hoellerich |
| 3,930,431 | A | 1/1976 | Magadini |
| 4,567,808 | A | 2/1986 | Smith |
| 4,691,613 | A | 9/1987 | Jacobson |
| 4,747,333 | A | 5/1988 | Hoshino |
| 4,782,733 | A | 11/1988 | Herring |
| 5,398,584 | A | 3/1995 | Liao |
| 5,574,237 | A | 11/1996 | Yanagisawa |
| 5,590,147 | A | 12/1996 | Hobbs et al. |
| 5,936,177 | A | 8/1999 | Shigenaga |
| 6,137,040 | A | 10/2000 | Hoshino |
| 6,166,312 | A | 12/2000 | Brewster et al. |
| 6,199,354 | B1 | 3/2001 | King et al. |
| 6,570,076 | B1 | 5/2003 | Kjellgren |
| 6,590,147 | B2 | 7/2003 | Kassabian |
| 6,894,210 | B1 | 5/2005 | Lombardi |

(Continued)

FOREIGN PATENT DOCUMENTS

| | | | | |
|---|---|---|---|---|
| DE | 102013104569 | * | 9/2014 | ..... G10D 13/00 |
| GB | 1538145 | A | 1/1979 | |

(Continued)

*Primary Examiner* — Kimberly R Lockett
(74) *Attorney, Agent, or Firm* — Dwayne E Rogge; Puget Sound Patents

(57) ABSTRACT

Disclosed herein is a drum mechanism comprising in one example: a first end configured to be attached to a foot pedal axle shaft; a second end configured to be attached to a foot pedal stationary frame; the foot pedal stationary frame configured to be positioned adjacent a drumhead such that rotation of a drum beater attached to the foot pedal will impact the drumhead when swung about a pivot of the foot pedal; the drum compression spring mechanism configured to bias the drum beater away from the drumhead; a shaft extending from the pedal axle shaft to a piston adjustably connected to the shaft; and a resilient member positioned between the piston and the spring housing when the foot pedal is actuated.

6 Claims, 4 Drawing Sheets

(56) References Cited

U.S. PATENT DOCUMENTS

| | | | |
|---|---|---|---|
| 7,456,351 | B2 | 11/2008 | Dorfman et al. |
| 7,601,902 | B1 | 10/2009 | Lombardi |
| 7,858,860 | B1 | 12/2010 | Dunnett |
| 8,735,705 | B1 | 5/2014 | Chen |
| 9,633,633 | B1 | 4/2017 | Dunnett |
| 2003/0047060 | A1 | 3/2003 | Cocca |
| 2003/0226442 | A1 | 12/2003 | Dennis et al. |
| 2004/0060421 | A1 | 4/2004 | Yun |
| 2004/0144198 | A1 | 7/2004 | Gatzen |
| 2006/0156900 | A1 | 7/2006 | Dorfman et al. |
| 2006/0156901 | A1 | 7/2006 | Dorfman et al. |
| 2007/0295191 | A1 | 12/2007 | Dorfman et al. |
| 2008/0017015 | A1 | 1/2008 | Chen |
| 2014/0090543 | A1 | 4/2014 | Kitching |

FOREIGN PATENT DOCUMENTS

| | | | |
|---|---|---|---|
| JP | 3584898 | B2 | 11/2004 |
| JP | 3707423 | B2 | 10/2005 |

* cited by examiner

BASS DRUM PEDAL COMPRESSION MECHANISM

RELATED APPLICATIONS

This application claims priority of U.S. Provisional Patent Application Ser. No. 63/086,553 filed on Oct. 1, 2020, and U.S. Provisional Patent Application Ser. No. 63/125,241 filed on Dec. 14, 2020, both incorporated herein by reference.

BACKGROUND OF THE DISCLOSURE

Field of the Disclosure

This disclosure relates generally to drumming apparatuses, and more particularly to a beater assembly which may be operated by a user's foot wherein the adjustment assembly comprises a spring which allows the user to adjust the force of the beater shaft relative to the user's pressure on a foot pedal.

BRIEF SUMMARY OF THE DISCLOSURE

Disclosed herein is a drum compression mechanism comprising in one example: a first end configured to be attached to a foot pedal beater clamp; a second end configured to be attached to a foot pedal stationary frame; the foot pedal stationary frame configured to be positioned adjacent a drumhead such that rotation of a drum beater attached to the foot pedal will impact the drumhead when swung about a pivot of the foot pedal; the drum compression mechanism configured to bias the drum beater away from the drumhead; a shaft extending from the pedal axle shaft to a piston adjustably connected to the shaft; and a compression member compressed between the piston and the compression housing when the foot pedal is actuated.

The drum compression mechanism may further comprise an elastomer compressed between the piston and the compression member housing when the foot pedal is actuated.

The drum compression mechanism may be arranged wherein the piston comprises helical threads such that adjustment of the effective length of the shaft is accomplished by rotating the piston relative to the shaft.

DETAILED DESCRIPTION OF THE DISCLOSURE

Beater assemblies, which are utilized by a drummer's foot to pivot a beater about an axis to impact a drum, are well known in the art. One such assembly includes U.S. 704,308 which was patented Jul. 8, 1902, shows a foot pedal with a beater attached thereto to impact the bass drum and/or cymbal when the foot pedal is depressed. As with most of these assemblies, the beater rotates about a shaft and impacts the face of the drum or a cymbal. These assemblies generally comprise a pedal which is contacted by the user's foot, and some sort of a motion translation assembly which translates the vertical motion of one's foot on the pedal to rotation of the mallet about an axis. A coil spring "O" is often installed therebetween to bias the beater away from the drumhead for subsequent action.

A great many improvements over this basic assembly have been conceived, including U.S. 5,431,081, which includes a chain which connects the foot pedal to the axis of rotation. In some embodiments, a cam-like member can be utilized to adjust the relative motion of the pedal to the swing of a mallet to a desired orientation, such as to create a large amount of leverage for the initial motion of the mallet, and then a shorter lever arm which increases the speed of the mallet once the mallet has initially begun to turn or pivot.

Disclosed herein is an improvement to known bass drum beater foot pedal assemblies. The improvement incorporates an adjustable bass drum pedal spring mechanism 20 configured to bias a base drum beater 22 to a position away from the drum 24 which the beater 22 beats against.

Figure 2:
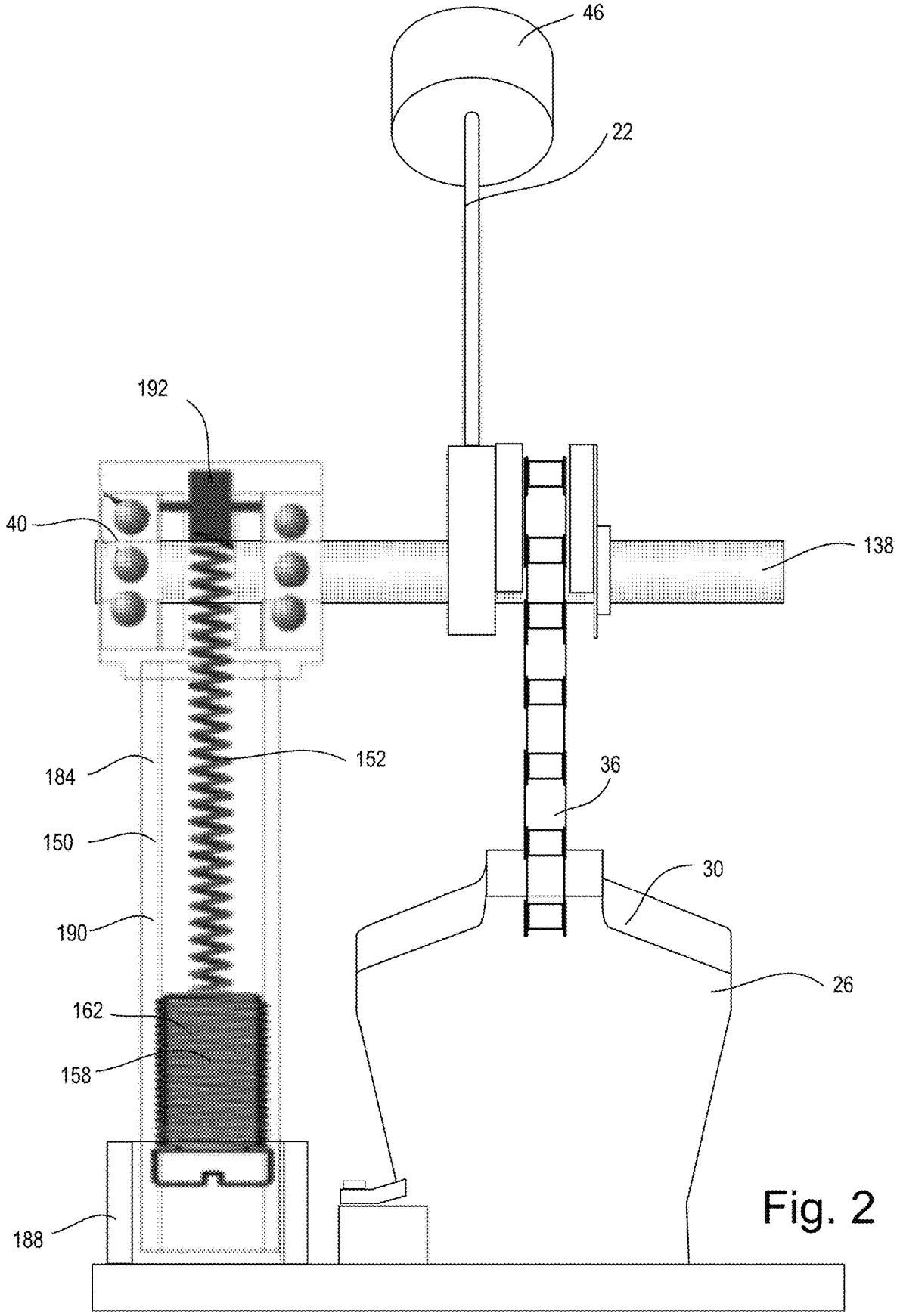
FIG. 2 is a side section view of one example of the foot pedal assembly adjacent a drum.

In operation, using the example foot pedal 26 of FIG. 2 for illustration as the foot pedal 26 is depressed by a user pressing on the foot plate 30, the foot plate pivots 32 around an axis 34. The opposing end of the foot plate 30 moves as result of this force in direction 28 and pulls on a drive chain 36 or equivalent. The drive chain 36 connected to a pedal axle shaft 38 which rotates about a pivot 40 when the drive chain 36 is pulled by movement of the foot pedal 26. This rotational movement 42 translated to rotational movement 44 or swing of the beater 22, particularly the beater head 46 toward the drumhead 48 portion of the drum 24 where the beater head 46 impacts the drumhead 48 to make sound.

To re-set the foot pedal 26 to the position shown in FIG. 2, an adjustable bass drum pedal mechanism 20 is provided to replace the tension spring normally used. This allows retrofit of the adjustable bass drum pedal mechanism 20 to most all known foot pedals 26.

Figure 4:
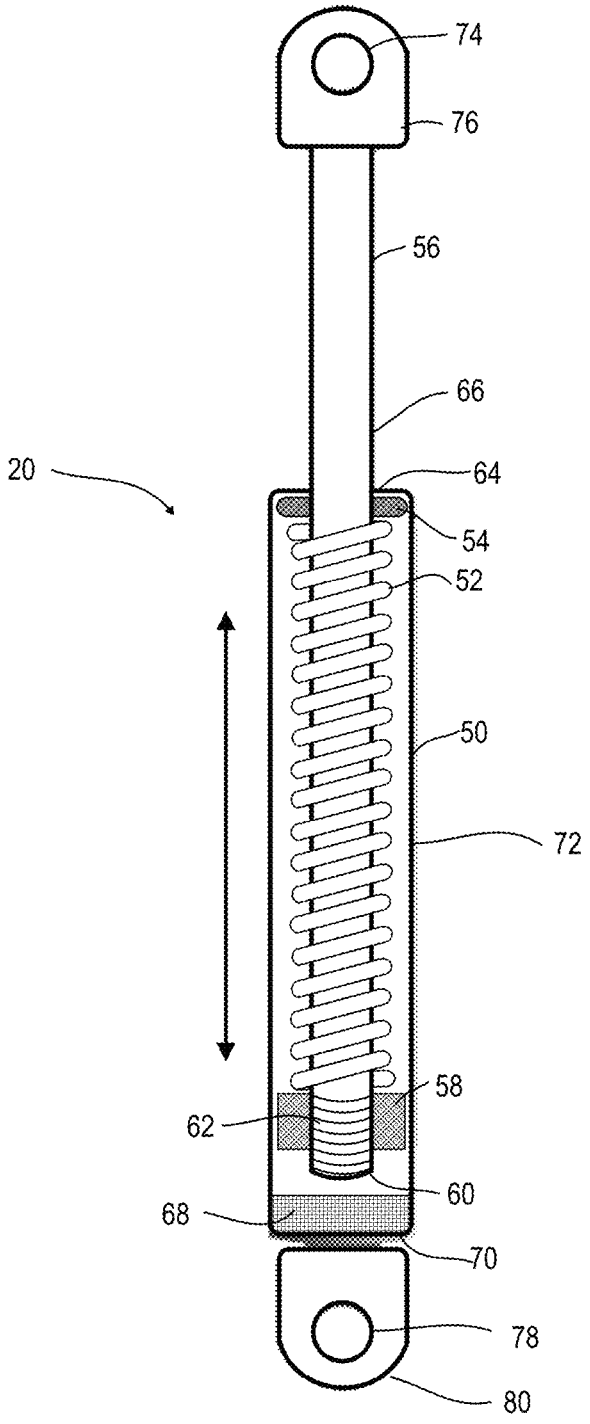
FIG. 4 is an enlarged cutaway view of one example of a spring mechanism component.

FIG. 4 shows a cutaway view of one example of the disclosed compression assembly 20 comprising a compression housing 50 in which is positioned a spring member 52, which may be a compression spring, tension spring, elastomer, pneumatic spring, or an equivalent, along with an elastomer 54, an equivalent of either, or a spring/elastomer combination. A shaft 56 passes through the compression spring 52 and/or elastomer 54 and engages a piston 58 at a first end 60 thereof. In the example shown, helical threads 62 are provided on the end of the shaft 56 such that rotation of the shaft 56 relative to the piston 58 adjusts compression of the spring 52/compression elastomer 54, resulting in a change to the force biasing the foot pedal to the return position of FIG. 2. This compression member adjustment also changing the force a user must exert on the foot plate 30 to swing the beater 22 to the drumhead 48.

In another example, the threads 62 are provided on the first end 64 of the spring housing 50 and the adjacent outer surface 66 of the shaft 56. Thus, rotation of the shaft 56 relative to the spring housing 50 adjusts the spring 52, resulting in a change to the speed and force biasing the foot pedal to the return position of FIG. 2. This adjustment may also change the force a user must exert on the foot plate 30 to swing the beater 22 to the drumhead 48.

In one example, the spring 52/compression elastomer 54 may be easily removed and replaced, such as for using a spring 52/compression elastomer 54 with different spring constants, or for replacing the elastomer 54 with an elastomer 54 with a different durometer (hardness). In one example, this can be accomplished by removing the piston 58, removing the spring 52, and replacing both.

In one example, the compression housing 50 may be substantially enclosed, where an end plug 68 is threaded or otherwise fixed to the second end 70 of the compression housing 50. Removal of the end plug 68 allows removal of the piston 58, compression spring 52, and/or elastomer 54.

In another example, one or more sides 72 of the compression housing 50 is open to allow access to and removal of the compression spring 52 and/or elastomer 54.

Figure 3:
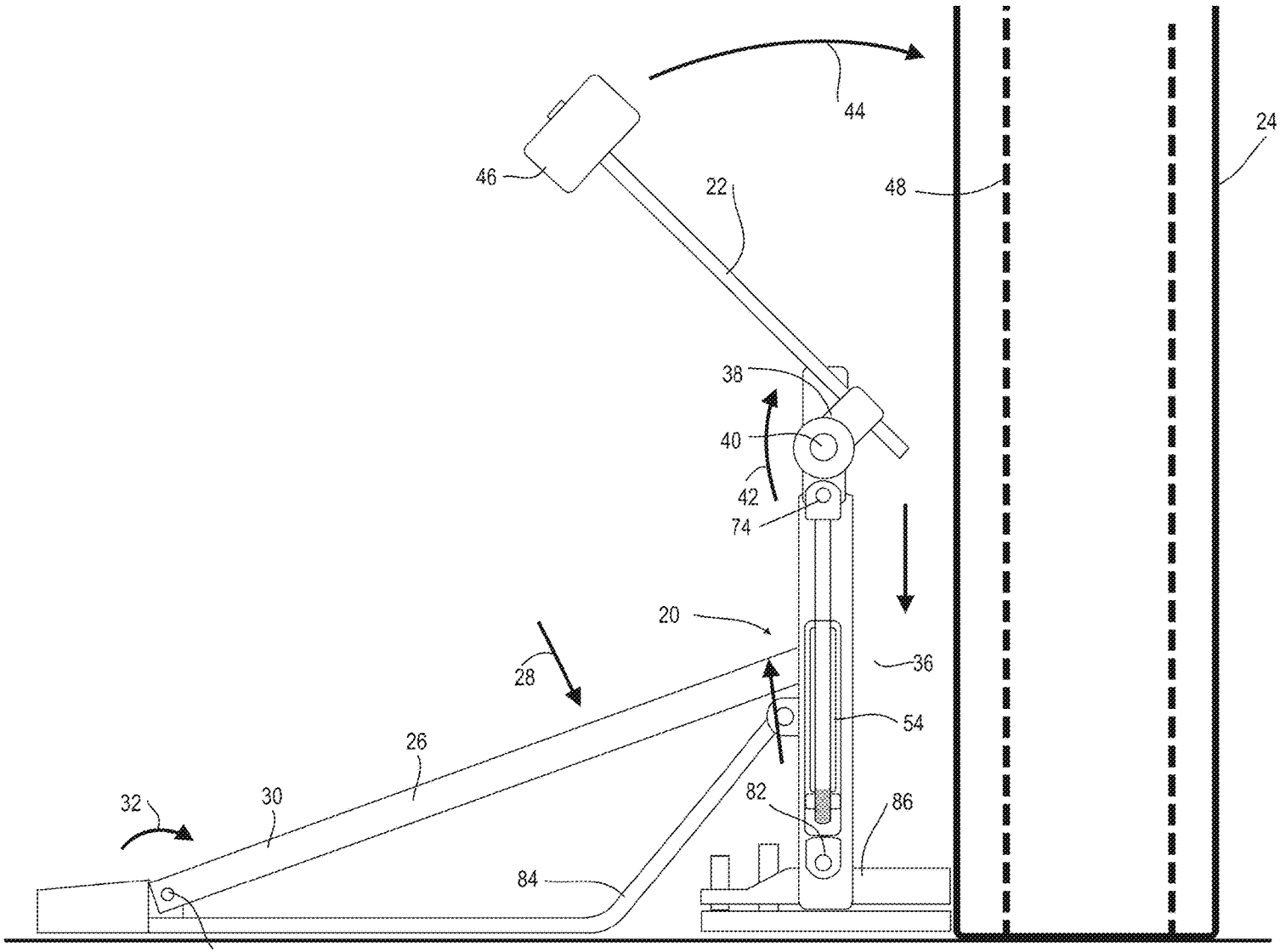
FIG. 3 a side section view of one example of the foot pedal assembly adjacent a drum.

In the example shown in FIG. 4, the shaft 56 has a first eye 74 at a first end 76 thereof for rotational attachment via a cam arm 92 or extension to the pedal axle shaft 38 as shown in FIG. 3. Similarly, the second end of the compression housing 50 or end plug 68 has a second eye 78 at a second end thereof, configured to rotatably attach to a pivot 82 of the foot pedal 26. The pivot 82 may be fixed to the frame 84 or hoop clamp 86 of the foot pedal 26.

In operation, the compression assembly 20 biases the foot pedal 26 to the return position of FIG. 2. Thus, after the beater 22 is swung 44 towards the drumhead 48, the user may reduce or release force on the foot plate 30 and the assembly 20 biases the foot plate 30 and beater 22 to the return position of FIG. 2.

Figure 1:
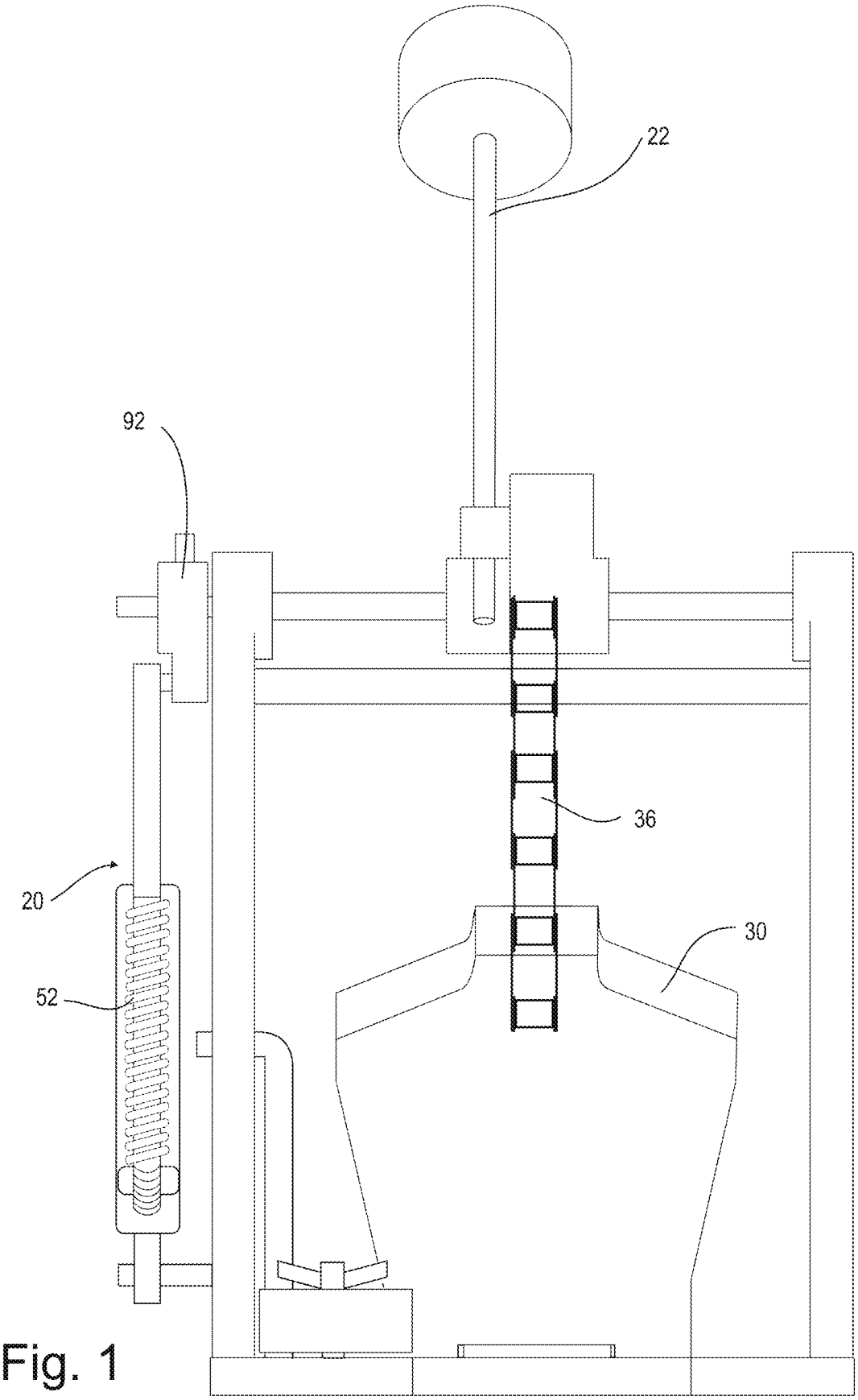
FIG. 1 is a rear section view of a foot pedal assembly using a disclosed compression spring mechanism.

In the example shown in FIG. 2, the frame 184 comprises a base 188 equivalent to the base of the other examples which rests on the floor, and a stanchion 190. The stanchion 190 extends from the base 188 to the pedal axle shaft 138 which in this example is cantilevered from the stanchion 190, a second stanchion may be included as shown in FIG. 1.

In this example, the spring housing 50 and stanchion 190 are the same structure. In this way, cost of material, weight, visual appeal, and many other factors are all improved. The example shown in FIG. 1 is more desired for some applications. In this example, the piston 158 has external male threads 162 thereon, while the stanchion 190/spring housing 150 has cooperative female threads thereon. These helical threads 162 are equivalent to the threads 62 of the example in FIG. 4. These threads 162 allow the piston to be moved axially as it is rotated relative to the stanchion 190 such that a preload of the spring 152 may be adjusted similarly to the preload adjustment previously described. The spring 152 may be a compression spring, tension spring, elastomer, pneumatic spring, or an equivalent, mechanism connected to a cam arm 192 fixed to the pivot axle shaft 138. This spring assembly configured to bias the drum beater away from the drumhead.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A drum compression mechanism comprising:

a first end rotationally attached to a cam arm fixed to a foot pedal axle shaft;

a second end rotationally attached to a foot pedal stationary frame;

the foot pedal stationary frame configured to be positioned adjacent a drumhead such that rotation of a drum beater attached to the foot pedal will impact the drumhead when swung about a pivot of the foot pedal;

wherein the drum compression mechanism configured to bias the drum beater away from the drumhead;

a shaft extending from the pedal axle shaft to a piston connected to the shaft; and a compression member compressed between the piston and the compression housing when the foot pedal is actuated.

2. The drum compression spring mechanism as recited in claim 1 wherein the compression member comprises a spring.

3. A drum compression spring mechanism comprising:

a first end configured to be attached to a foot pedal axle shaft;

a second end configured to be attached to a foot pedal stationary frame;

the foot pedal stationary frame configured to be positioned adjacent a drumhead such that rotation of a drum beater attached to the foot pedal will impact the drumhead when swung about a pivot of the foot pedal;

the drum compression mechanism configured to bias the drum beater away from the drumhead;

a shaft extending from the pedal axle shaft to a piston connected to the shaft;

a compression member compressed between the piston and the compression housing when the foot pedal is actuated;

wherein the compression member comprises a spring and further comprising an elastomer compressed between the piston and the spring housing when the foot pedal is actuated.

4. The drum compression spring mechanism as recited in claim 1 a first end configured to be attached to a foot pedal axle shaft;

a second end configured to be attached to a foot pedal stationary frame;

the foot pedal stationary frame configured to be positioned adjacent a drumhead such that rotation of a drum beater attached to the foot pedal will impact the drumhead when swung about a pivot of the foot pedal;

the drum compression mechanism configured to bias the drum beater away from the drumhead;

a shaft extending from the pedal axle shaft to a piston connected to the shaft;

a compression member compressed between the piston and the compression housing when the foot pedal is actuated;

wherein the piston comprises helical threads such that adjustment of the effective length of the shaft is accomplished by rotating the piston relative to the shaft.

5. The drum compression spring mechanism as recited in claim 1 wherein the compression member comprises an elastomer.

6. The drum compression spring mechanism as recited in claim 4 wherein the compression member comprises an elastomer.

* * * * *